US009359893B2

(12) United States Patent
Rohwer et al.

(10) Patent No.: US 9,359,893 B2
(45) Date of Patent: Jun. 7, 2016

(54) APPARATUS FOR THE MILLING CUTTING OF ROCK, MINERALS OR OTHER MATERIALS

(75) Inventors: Jan Rohwer, Dortmund (DE); Jens Steinberg, Lünen (DE); Joachim Raschka, Bochum (DE); Frank Herrmann, Chemnitz (DE); Christian Schreiter, Drebach (DE)

(73) Assignee: Caterpillar Global Mining Europe GmbH, Lünen (DE)

( * ) Notice: Subject to any disclaimer, the term of this patent is extended or adjusted under 35 U.S.C. 154(b) by 123 days.

(21) Appl. No.: 14/116,549

(22) PCT Filed: Apr. 24, 2012

(86) PCT No.: PCT/IB2012/052056

§ 371 (c)(1), (2), (4) Date: Nov. 21, 2013

(87) PCT Pub. No.: WO2012/156842

PCT Pub. Date: Nov. 22, 2012

(65) Prior Publication Data

US 2014/0084667 A1 Mar. 27, 2014

(30) Foreign Application Priority Data

May 16, 2011 (DE) ..... 20 2011 050 144 U

(51) Int. Cl.
*E21C 27/24* (2006.01)
*B28D 1/18* (2006.01)
(Continued)

(52) U.S. Cl.
CPC . *E21C 27/24* (2013.01); *B28D 1/18* (2013.01); *E21C 27/22* (2013.01); *E21C 31/02* (2013.01)

(58) Field of Classification Search
CPC ..... E21C 27/24
USPC ..... 299/85.1, 64–66, 68, 71–78
See application file for complete search history.

(56) References Cited

U.S. PATENT DOCUMENTS 2,730,344 A * 1/1956 Cartlidge ..... E21C 27/126 299/110
3,412,816 A 11/1968 Lautsch
(Continued)

FOREIGN PATENT DOCUMENTS

CN 1033860 7/1989
CN 1646787 7/2005
(Continued)

OTHER PUBLICATIONS

International Search Report and Written Opinion for International Application No. PCT/IB2012/052056, dated Mar. 28, 2013, 8 pages.

*Primary Examiner* — Sunil Singh

(57) ABSTRACT

An apparatus for the milling cutting of rock, minerals or other hard materials has a tool drum which is rotatably mounted on a drum carrier about a drum axis and on the peripheral shell surface of which are disposed, in distributed arrangement, a plurality of tool carriers, which carry cutting tools and can be rotatingly driven, where their shaft axes run transversely to the drum axis. A first group of tool carriers and a second group of tool carriers are provided, where the rotational direction of the first group is counter to the rotational direction of the second group, and the shaft axes of the tool carriers of the first group and of the second group are oriented at different setting angles relative to the radial direction of the tool drum.

19 Claims, 6 Drawing Sheets

(51) Int. Cl.
*E21C 27/22* (2006.01)
*E21C 31/02* (2006.01)

(56) References Cited

U.S. PATENT DOCUMENTS 5,924,222 A 7/1999 Stoetzer
7,896,445 B2 * 3/2011 Bechem ..... 299/85.1
2008/0116734 A1 * 5/2008 Bechem et al. ..... 299/10

FOREIGN PATENT DOCUMENTS

CN 101111662 1/2008
CN 101512101 8/2009
DE 288 984 5/1915
WO WO 2008/025555 3/2008

* cited by examiner

APPARATUS FOR THE MILLING CUTTING OF ROCK, MINERALS OR OTHER MATERIALS

CROSS-REFERENCE TO RELATED APPLICATIONS

This application claims the benefit of priority to international patent application number PCT/IB2012/052056, having a filing date of Apr. 24, 2012, which claims the benefit of priority to German patent application number DE202011050144.2, having a filing date of May 16, 2011, the complete disclosures of which are hereby incorporated by reference for all purposes.

TECHNICAL FIELD

The invention relates to an apparatus for the milling cutting of rock, minerals or other, in particular hard, materials, comprising a tool drum mounted on a drum carrier rotatably about a drum axis, and comprising a plurality of tool carriers, which are arranged distributed over the periphery of the tool drum and carry cutting tools and which can be rotatingly driven and the shaft axes of which run transversely to the drum axis.

BACKGROUND

An apparatus of this type is known from WO 2008/025 555 A1. With this known apparatus, it is possible, with high stock removal rate and large removal surface, to mine rock or other hard materials economically, wherein the mill cutting or stock removal takes place radially outside the periphery of the tool drum. The known apparatus can advantageously be used to drive galleries or tunnels with the aid of part-face heading machines provided with an arm which is pivotable transversely to the main direction of advance and on the front end of which the tool drum is rotatably mounted.

It has been shown, however, that precisely in such applications, the efficiency of the apparatus with its tool carriers, which in the milling operation all rotate in the same direction, is still open to improvement. The rotational direction which is the same for all tool carriers has a detrimental impact, in particular, when the machine extension arm, which carries the tool drum, is pivoted to and fro, in that namely the milling performance in one pivoting direction of the machine extension arm is better than in the other pivoting direction.

The invention has set out to avoid these drawbacks observed in connection with the known apparatus and to improve an apparatus for the milling cutting of rock or the like, of the type stated in the introduction, such that, irrespective of the motional direction of the tool drum, an equally good milling performance of the cutting tools mounted on the tool carriers is achieved.

SUMMARY

This object is achieved with the invention by virtue of the fact that a first group of tool carriers and a second group of tool carriers are provided, and that the rotational direction of the first group is counter to the rotational direction of the second group. The arrangement is here preferably made such that the tool carriers of the first group and of the second group are arranged alternately to one another on the periphery of the tool drum. Alternatively, the arrangement can also, however, be made such that the tool carriers of the first group are arranged next to the tool carriers of the second group on the periphery of the tool drum, wherein, preferably, a tool carrier of the first group and a tool carrier of the second group are then respectively arranged side by side in pairs.

According to the invention, the rotational directions of the tool carriers thus alternate and, by virtue of the different rotational directions, a milling result of the cutting tools which is equally good in both motional directions of the tool drum is obtained.

It is quite especially advantageous if the shaft axes of the tool carriers of the first group and the shaft axes of the tool carriers of the second group are oriented and/or orientable at different setting angles relative to the radial direction of the tool drum. The tilting of the tool carriers of the two groups at different setting angles allows the tools to be optimally oriented for the cutting of the material. Preferably, the arrangement is made such that the shaft axes of the tool carriers of the first group and the shaft axes of the tool carriers of the second group are oriented such that they are mutually inclined, wherein the shaft axes of the tool carriers of the first group can span a first conical surface about the drum axis and the shaft axes of the tool carriers of the second group can span a second conical surface about the drum axis, wherein the conical surfaces are oriented in mirror image to one another and preferably have at least approximately the same included angle. In this arrangement, it is possible that, when the tool drum is moved with the aid of the pivot arm which supports it, only the tools of the first group loosen the material to be cut, whilst the tools of the second group run freely, i.e. do not engage with the material until the movement of the tool drum stops and this, following advancement by the cutting depth, is pivoted or moved back in the opposite direction. In the case of this opposite cutting direction, the tools which have previously participated in the extraction are then out of engagement with the rock.

It is possible to assign to each tool carrier a dedicated drive. It has proved particularly advantageous, however, if the tool carriers of the first and/or second group have a common drive. The arrangement can be made, for instance, such that the common drive comprises a crown gear arranged concentrically to the drum axis, and a respective bevel gear, which meshes with this crown gear, for each tool carrier of the first and/or second group. In this design it is possible for the crown gear to be arranged in a rotationally secure manner on the drum axis, whilst the tool drum rotates around the axis, whereby the tool carriers are set in rotation by the same drive as the tool drum and a fixed speed ratio between the speed of the tool drum and the speed of the tool carriers is obtained.

In this configuration, each tool carrier can be connected to a drive shaft, which at its other end supports the bevel gear. For a particularly stable configuration, the drive shaft can be in the form of a rigid shaft. It is also possible, however, to use an articulated shaft, preferably a Cardan shaft, which is of advantage, in particular, when the setting angle at which the tool carriers are inclined is intended to be variable.

In an advantageous refinement of the invention, it is provided that the crown gear is toothed on both sides, and that the bevel gears for the tool carriers of the first group mesh with the toothing of the crown gear on its one side and the bevel gears for the tool carriers of the second group mesh with the toothing of the crown gear on its other side. It is substantially equivalent to such a solution to provide unilaterally toothed crown gears which are arranged back to back on the drum axis, though, given an appropriately large setting angle of the shaft axes, they can also be arranged at a distance apart on the drum axis.

The drive shafts are expediently accommodated in a protected manner inside the tool drum, whereby a premature wearing of gearwheels and bearings can be avoided. As already indicated, the tool drum and the tool carriers can be drivable by a common drive, wherein a design in which the crown gear or crown gears of the bevel gear steps for the tool carriers is/are arranged on a common drive shaft with the sun wheel of a planetary gearing, via which the tool drum is driven, has proved particularly advantageous. In a particularly compact construction, this design allows maximum possible flexibility in the fixing of the speed ratios between the speed of the tool carriers and the speed of the tool drum. It is also possible, however, that, though the tool carriers have a common drive, this is independent from a drive for the tool drum, whereby the rotational velocity of the tool carriers can be made particularly advantageously to be adjustable independently from the rotational velocity of the tool drum.

Preferably, the tool drum is closed on its periphery with shell surface segment caps, which are roughly trapezoidal in shape and are arranged inclined alternately at the different setting angles to the radial direction, and in which the tool carriers are rotatably mounted. It has proved particularly effective if the setting angles of the shaft axes of the first and second group are inclined within the range from ±3° to ±9° to the radial direction of the tool drum. In such an arrangement, it can be reliably ensured—where necessary, with slight tilting of the tool drum relative to its direction of advance—that, in the milling cutting of the rock or the like, it is only ever the tools of the tool carriers of the first or second group which are engaged with the rock, whilst the tools of the tool carriers of the respectively other group, which are located behind the engaged tools in the direction of advance of the drum, rotate in the already cut-out space and thus have no contact with rock or the like until the direction of advance of the drum is reversed again and, upon the return motion of the drum, the tools of the tool carriers of the other group are then used.

BRIEF DESCRIPTION OF THE DRAWINGS

Further features and advantages of the invention emerge from the following description and the drawing, in which preferred embodiments of the invention are explained in greater detail on the basis of examples, wherein.

DETAILED DESCRIPTION

Figure 1:
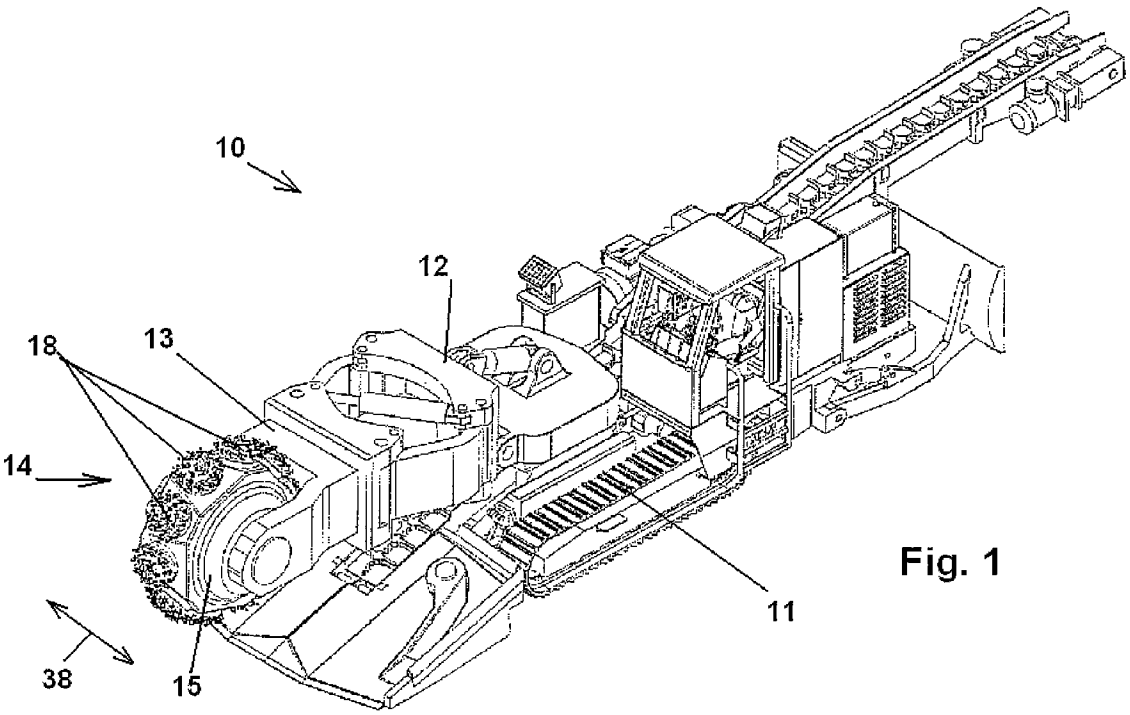
FIG. 1 shows a part-face heading machine for driving tunnels or the like in underground tunnelling or mining, comprising a milling apparatus according to the invention in perspective representation.
Figure 2:
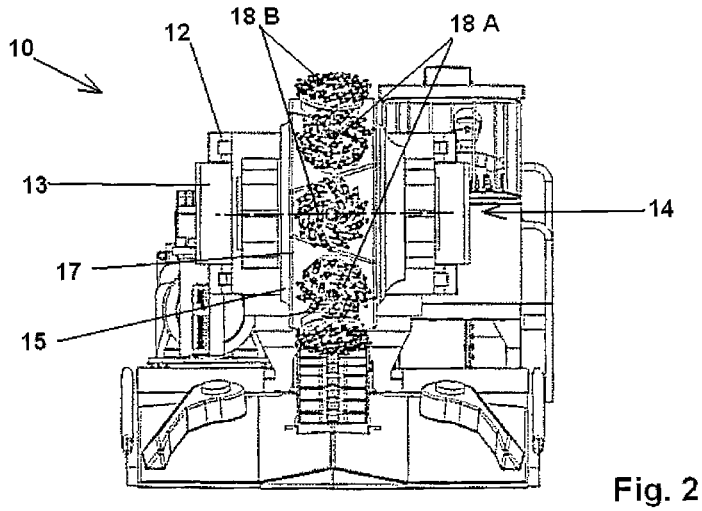
FIG. 2 shows the subject of FIG. 1 in a front view.

FIG. 1 depicts a part-face heading machine, denoted in its entirety as 10, as can be used in underground mining, for instance for the driving of drifts. In a manner which is known per se, the machine 10 has a running gear 11 having an extension arm 12, which latter is mounted such that it can be pivoted and moved up and down and to the front end of which, pointing towards the working face, is attached a forked drum holder 13. The drum holder serves to receive an apparatus 14 for the milling cutting of the material to be extracted or broken loose, which apparatus is the subject of the present invention.

As can be seen from the drawings, the milling apparatus 14 has a tool drum 15, which is accommodated in the drum carrier 13 such that it is mounted rotatably about a drum axis 16.

The tool drum 15 forms a peripheral shell surface 17, over the periphery of which is disposed in distributed arrangement a row of tool carriers 18, which latter are equipped with cutting tools for the material to be milled out/extracted, for instance with point attack picks 19. The tool carriers have shaft axes 20, which run transversely to the drum axis 16 and are driven rotatably about this.

Figure 3:
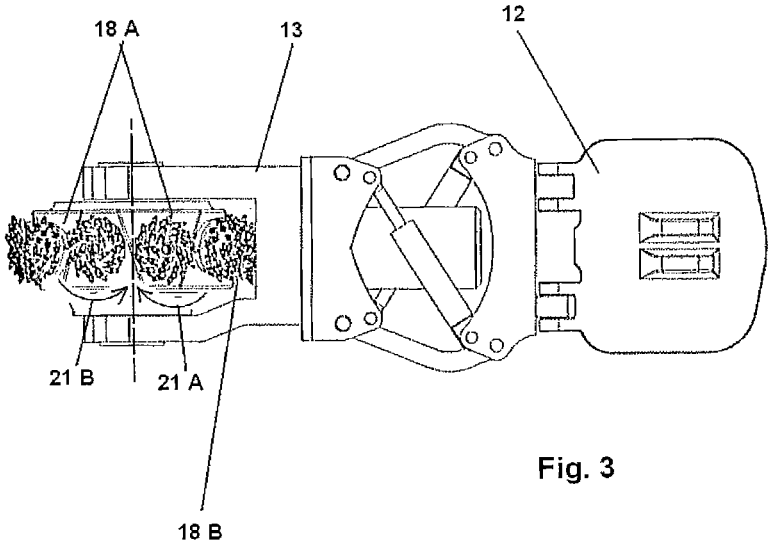
FIG. 3 shows in detail the milling apparatus according to the invention, mounted on an extension arm of the machine according to FIG. 1, in a top view.
Figure 4:
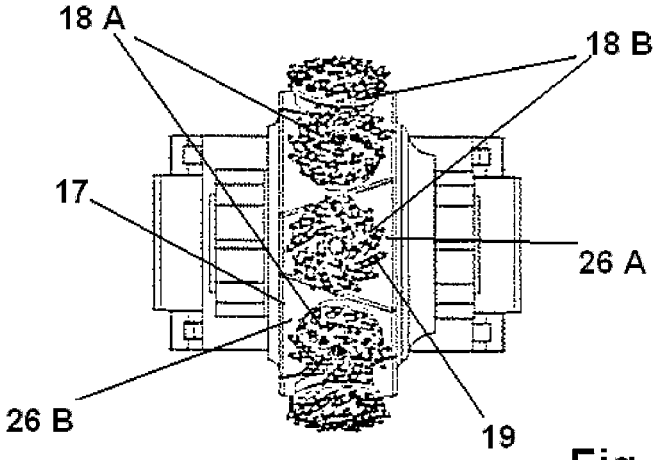
FIG. 4 shows the subject of FIG. 3 in a front view.
Figure 5:
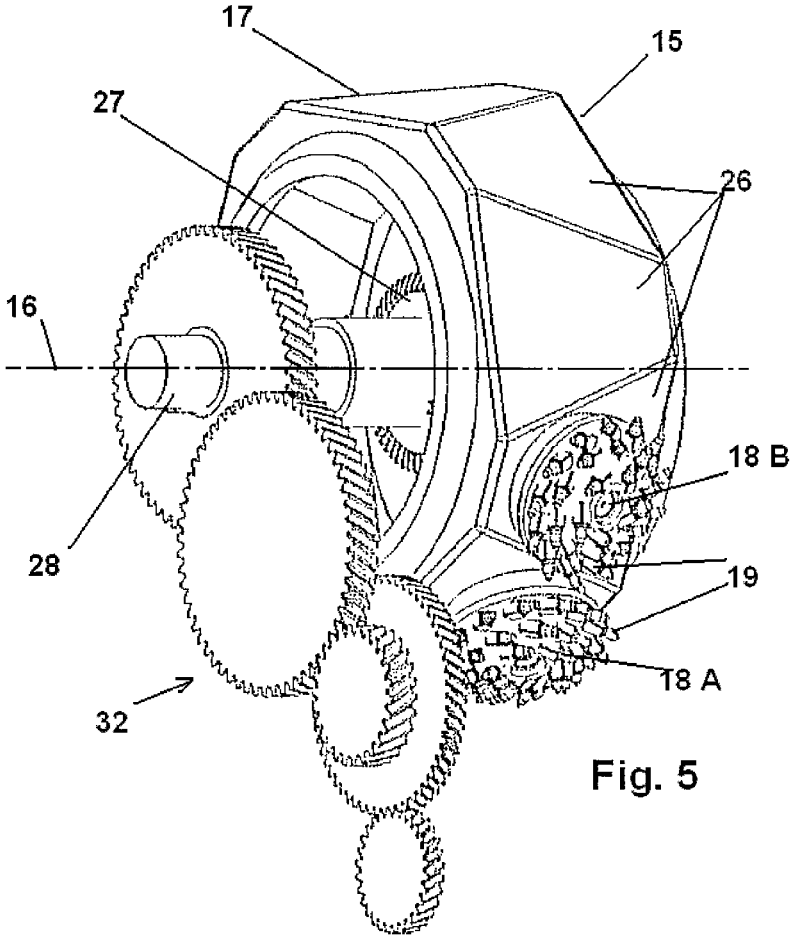
FIG. 5 shows a first embodiment of the milling apparatus according to the invention in a perspective representation.
Figure 6:
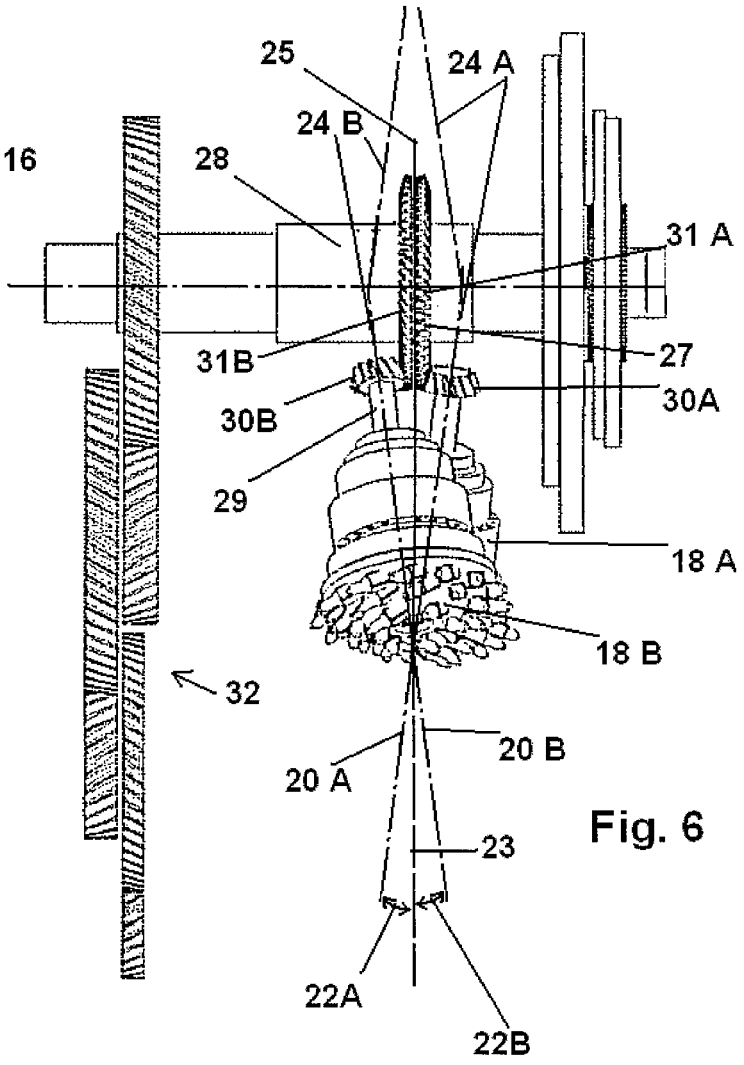
FIG. 6 shows a common drive for the tool carriers of the apparatus according to FIG. 5 in a top view.

According to the invention, the tool carriers are divided into two groups A, B, wherein, in the embodiment according to FIGS. 5 and 6, the arrangement is made such that a tool carrier 18A of one group A always alternates with a tool carrier 18B of the other group B. The tool carriers of the two groups have opposite rotational directions, so that respectively adjacent tool carriers on the periphery of the tool drum rotate in opposite directions when their drive is active. The different rotational directions are identified in FIG. 3 by the arrows 21A and 21B.

Figure 7:
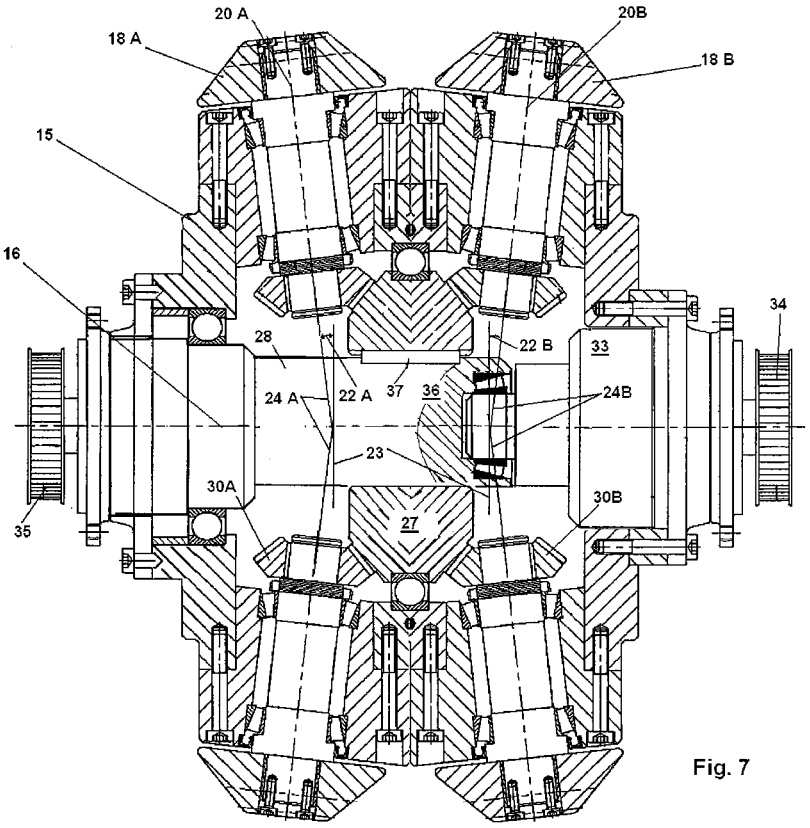
FIG. 7 shows a second embodiment of the apparatus according to the invention in section.

As can further be seen from the drawings, the shaft axes 20A of the tool carriers 18A of the first group A and the shaft axes 20B of the tool carriers 18B of the second group B are oriented at different setting angles 22A and 22B relative to the radial direction 23 of the tool drum 15. The shaft axes 20A of the tool carriers 18A of the first group A and the shaft axes 20B of the tool carriers 18B of the second group B are thus mutually inclined, wherein the shaft axes 20A of the first group A span a first conical surface 24A about the drum axis 16 and the shaft axes 20B of the second group B span a second conical surface 24B about the drum axis 16, as is indicated in FIGS. 6 and 7. The two conical surfaces 24A, B are here oriented one to the other in mirror image to the centre plane 25 of the tool drum and have the same included angle, which corresponds to the setting angles 22A and 22B.

In FIG. 5, in particular, it can be clearly seen that the individual tool carriers 18 are mounted rotatably in shell surface segment caps 26, which are configured on the periphery of the tool drum 15 and are roughly trapezoidal in shape. The segment caps are arranged inclined alternately at the different setting angles 22A and 22B, wherein the longer of their mutually parallel side edges lie with their middle region radially farther in than the shorter of the parallel side edges.

Each of the tool carriers 18 can be driven by a dedicated rotary drive, for instance by compactly built gear motors, which inside the tool drum 15 are flange-connected to the bottom sides of the segment caps 26. In the represented illustrative embodiments, however, the tool carriers 18 of both groups A, B have a common drive, which for the first embodiment can best be seen in FIG. 6. The common drive substantially consists of a bilaterally toothed crown gear 27, which concentrically to the drum axis 16, in the first embodiment, is mounted in a rotationally secure manner on a bearing axle 28 for the tool drum 15. Each tool carrier is connected in a rotationally secure manner to a drive shaft 29, which at its other, radially inner end supports a bevel gear 30, which meshes with the crown gear 27 of the common drive. The bevel gears on the drive shafts for the tool carriers of the first group A here engage with the toothing 31A of the crown gear 27 on its one side and the bevel gears for the drive shafts of the tool carriers of the second group B engage with the toothing 31B of the crown gear on its other side, as can be clearly seen in FIG. 5. Here, the setting of the shaft axes 20 of the tool carriers 18 relative to the radial direction 23 (=centre plane of the crown gear) is also clearly discernible.

If the tool drum is set in rotation by its drive motor (not represented) via the spur gear 32 represented in FIGS. 5 and 6, a relative rotation of the drum in relation to the non-position-changing crown gear 27 comes about. Since the tool carriers 18 on the periphery of the tool drum are taken along by the latter, they are set in rotation by the rigidly fixed crown gear via the bevel gear steps, wherein the tool carriers 18A rotate in one rotational direction 21A and the tool carriers 18B rotate in the opposite rotational direction 21B. The speed ratio between the speed of the tool drum and the speed of the tool carriers is here constant and is determined by the transmission ratio of the bevel gear steps 27, 30.

The design structure of the second embodiment of a milling apparatus which is represented in FIG. 7 is basically very similar. Accordingly, for components which correspond to the components in the first embodiment of the milling apparatus, the same reference symbols are used. The fundamental differences in the second embodiment consist in the fact that the tool carriers 18A, B of the first and second group are not arranged alternately to one another in the peripheral direction, but instead a paired arrangement in which a tool carrier 18A can be found directly alongside a tool carrier 18B has here been chosen. In this second embodiment, furthermore, the tool carriers 18 do all have a common drive, which substantially consists of a bilaterally toothed crown gear 27 and therewith meshing bevel gears 30 on the drive shafts 29 of the tool carriers. This common drive is not however derived from the drive of the tool drum 15, as in the first embodiment, but independently therefrom. Whilst the tool drum in the embodiment according to FIG. 7 can be set in rotation via a gearwheel 34, which on the right in the drawing is flange-connected to the drum shaft 33, on the opposite side (on the left in FIG. 7) is found a second drive gear 35, with which a middle part 36 of the bearing axle 28, which middle part is mounted rotatably relative to the tool drum, can be driven. On this middle part 36, the crown gear 27 is fastened in a rotationally secure manner by means of a feather key 37. The design allows the rotational velocity of the tool carriers 18 to be set independently from the rotational velocity of the tool drum, to be altered during ongoing operation and, where necessary, even to be stopped, namely by synchronizing the rotation of the middle part 36 with the rotation of the tool drum 15.

Due to the different rotational directions of the tool carriers 18A, B carrying the cutting tools 19, and the additionally particularly preferred inclination of the shaft axes of the two groups A, B of tool carriers 18A, B in opposite directions, the inventive milling tool, when the tool drum 15 is tilted relative to its direction of advance 38, which is indicated in FIG. 1 by the double arrow, can be oriented, both in the forward travel and in the return travel of the tool drum, at the optimal loosening angle to the rock or the like to be cut, wherein preferably it is only ever the tool carriers of a group A or B which are engaged with the material to be loosened, whilst the tool carriers of the other group rotate freely without being involved in the loosening work. By defining different groups A, B of tool carriers for the movement of the tool drum to and fro, which movement is made substantially in the direction of its drum axis, it is possible, for the two opposite directions, to choose the setting angle of the tool carriers involved in the loosening work optimally for the respective circumstances, a setting angle of 3° to 9°, preferably around 6°, relative to the radial direction of the drum having proved particularly effective.

The invention is not limited to the represented and described illustrative embodiments, but rather various modifications and additions are possible without departing from the scope of the invention. For instance, it is not absolutely necessary that the drive shafts for the tool carriers are configured as substantially rigid, one-piece shafts, but instead articulated shafts, in particular Cardan shafts, can also be used here, which is expedient, in particular, when the tool drum has a comparatively large diameter and/or when the setting angles which the tool carriers have relative to the radial direction are intended to be variable. The bilaterally toothed crown gear can also be of two-piece construction, with spacers being able to be provided between the two crown gear parts, with the aid of which spacers the distance apart of the toothings of the crown gear, which toothings are arranged in mirror image to one another, can be altered, in order hereby to change the setting angle of the tool carriers.

The invention claimed is:

1. An apparatus for the milling cutting of rock, minerals or other hard materials, comprising:

a drum carrier;

a tool drum rotatably mounted on the drum carrier about a drum axis;

a plurality of tool carriers disposed over a periphery of the tool drum, each of the tool carriers being rotatably drivable by a drive shaft with a shaft axis, the shaft axes running transversely to the drum axis;

a plurality of cutting tools disposed on each of the tool carriers;

wherein a first group of the tool carriers rotate in a first direction and a second group of the tool carriers rotate in a second direction that is counter to the first direction.

2. An apparatus according to claim 1, wherein the first group of the tool carriers and the second group of the tool carriers are arranged alternately to one another on a shell surface of the periphery of the tool drum.

3. An apparatus according to claim 1, wherein the first group of the tool carriers are arranged next to the second group of the tool carriers on the periphery of the tool drum, and wherein a tool carrier of the first group and a tool carrier of the second group are respectively arranged side by side relative to a center plane of the tool drum in pairs.

4. An apparatus according to claim 1, wherein the shaft axes of the first group of the tool carriers and the shaft axes of the second group of the tool carriers are oriented at different setting angles relative to a radial direction of the tool drum.

5. An apparatus according to claim 4, wherein the shaft axes of the first group of the tool carriers and the shaft axes of the second group of the tool carriers are oriented such that they are mutually inclined.

6. An apparatus according to claim 5, wherein the shaft axes of the first group of the tool carriers span a first conical surface about the drum axis and the shaft axes of the second group of the tool carriers span a second conical surface about the drum axis, and wherein the first and second conical surfaces are oriented in mirror image to one another and have at least approximately the same included angle.

7. An apparatus according to claim 4, wherein the tool drum is closed with shell surface segment caps, which are approximately trapezoidal in shape and are arranged inclined alternately at the different setting angles to the radial direction, and in which the tool carriers are rotatably mounted.

8. An apparatus according to claim 4, wherein the setting angles of the shaft axes of the first and second group of the tool carriers are inclined within the range from ±3° to ±9° to the radial direction of the tool drum.

9. An apparatus according to claim 1, wherein each tool carrier is assigned a dedicated drive.

10. An apparatus according to claim 1, wherein the tool carriers have a common drive.

11. An apparatus according to claim 10, wherein the common drive comprises at least one crown gear arranged concentrically to the drum axis, and a respective bevel gear, which meshes with the crown gear, for each tool carrier.

12. An apparatus according to claim 11, wherein each tool carrier is connected to its drive shaft at a first end of the drive shaft, and a second end of the drive shaft supports the bevel gear.

13. An apparatus according to claim 12, wherein the drive shaft is one of a rigid shaft, an articulated shaft, or a Cardan shaft.

14. An apparatus according to claim 11, wherein the crown gear is toothed on both sides, and the bevel gears for the first group of the tool carriers mesh with toothing of the crown gear on its one side and the bevel gears for the second group of the tool carriers mesh with toothing of the crown gear on its other side.

15. An apparatus according to claim 1, wherein the drive shafts are disposed inside the tool drum.

16. An apparatus according to claim 1, wherein the tool drum and the tool carriers are drivable by a common drive.

17. An apparatus according to claim 1, wherein the tool carriers have a common drive, which is independent from a drive for the tool drum.

18. An apparatus according to claim 17, wherein a rotational velocity of the tool carriers is adjustable independently from a rotational velocity of the tool drum.

19. An apparatus for the milling cutting of rock, minerals or other hard materials, comprising:

a frame;

a drum carrier pivotally coupled to the frame;

a tool drum rotatably mounted about a drum axis on the drum carrier;

a first group of tool carriers and a second group of tool carriers, each having a shaft axis, and disposed about the periphery of each of the tool drums in an alternating arrangement;

cutting tools arranged on each of the tool carriers;

wherein the shaft axes of the first group of tool carriers are angularly offset from the drum axis at a first non-perpendicular angle, and the shaft axes of the second group of tool carriers are angularly offset from the drum axis at a second non-perpendicular angle, and the first and second angles being substantially equal and opposite to each other and on opposite sides of a center plane of the tool drum, and wherein the tool carriers have a common drive comprising at least one crown pear arranged concentrically to the drum axis, and a respective bevel gear, which meshes with the crown gear, for each tool carrier, wherein the crown gear is toothed on both sides, and the bevel gears for the first group of the tool carriers mesh with toothing of the crown gear on its one side and the bevel gears for the second group of the tool carriers mesh with toothing of the crown gear on its other side.

* * * * *